United States Patent [19]

Tyler et al.

[11] 4,076,975

[45] Feb. 28, 1978

[54] ELECTRICAL FURNACE AND PARTS THEREFOR

[75] Inventors: Hugh J. Tyler; Denis G. Wolfe, both of Santa Ana, Calif.

[73] Assignee: Robertshaw Controls Company, Richmond, Va.

[21] Appl. No.: 661,056

[22] Filed: Feb. 25, 1976

[51] Int. Cl.[2] ..... H05B 3/02

[52] U.S. Cl. ..... 219/483; 219/486

[58] Field of Search ..... 337/245, 254, 336, 370, 337/371, 78, 96; 219/483, 486, 484, 485

[56] References Cited

U.S. PATENT DOCUMENTS

| | | | |
|---|---|---|---|
| 3,161,758 | 12/1964 | Biermann et al. | 219/486 X |
| 3,385,100 | 12/1967 | Schleicher | 337/245 X |
| 3,579,264 | 5/1971 | Mork et al. | 219/486 |
| 3,813,626 | 5/1974 | Cetola | 337/245 |
| 3,852,695 | 12/1974 | Northrup | 337/96 X |
| 3,912,906 | 10/1975 | McIntosh | 219/486 |

*Primary Examiner*—J. V. Truhe

*Assistant Examiner*—Fred E. Bell

*Attorney, Agent, or Firm*—Candor, Candor & Tassone

[57] ABSTRACT

An electrical furnace has a plurality of electrical heaters and a control unit carried by a frame. A rigid lead unit is carried by the frame and has rigid lead means directly and electrically interconnected to terminals of the heaters and terminals of the control unit, the rigid lead unit itself having terminals for electrically interconnecting the rigid lead means to power source leads whereby the power source leads are directly and electrically interconnected to the terminals of the heater and the control unit by the rigid lead means without the need for auxiliary wiring. The control unit includes an electrical sequencing switch construction having a plurality of electrical switches for sequentially operating the heaters, the switch construction having a temperature sensing unit operatively interconnected to the switches for moving and holding the same in open conditions thereof when the temperature sensing unit senses a high temperature condition of the heaters.

20 Claims, 9 Drawing Figures

ELECTRICAL FURNACE AND PARTS THEREFOR

This invention relates to an improved electrical furnace construction as well as to improved parts for such an electrical furnace construction or the like.

It is well known that electrical furnaces have been provided wherein each has a plurality of electrical heaters carried by a frame means of the furnace construction, the electrical heaters being adapted to be sequentially operated by control means that are also carried by the frame means and are electrically interconnected to the heaters by flexible wiring.

However, it has been found that in each such prior known electrical furnace construction, multiple components of the control means are mounted to the frame means and all of the components require flexible electrical wiring therebetween in such a manner that a relatively expensive assembly operation is required for making the control system for the respective electrical furnace, let alone an expensive field maintenance problem.

It is a feature of this invention to provide improved parts for such an electrical control system wherein the number of components is reduced and the arrangement thereof is unique so that external flexible wiring is held to a minimum.

Further, it was found in the prior known electrical control systems for electrical furnaces that individual high limit switches were provided for each heating element to disconnect the power source therefrom when an adverse high temperature was sensed.

Accordingly, it is a feature of this invention to provide an improved means for disconnecting the power source from the electrical heaters when a high temperature condition exists.

In particular, one embodiment of this invention provides a frame means for an electrical furnace construction of the like, the frame means carrying a plurality of electrical heaters and a control means. A rigid lead unit is carried by the frame means and has rigid lead means directly and electrically interconnecting to terminals of the heaters and the control means, the rigid lead unit having terminal means for electrically interconnecting the rigid lead means to power source leads whereby the power source leads will be directly and electrically interconnected to the terminal means of the heaters and the control means by the rigid lead means whereby external wiring for the control system is held to an absolute minimum.

The control means of this invention includes an electrical sequencing switch construction having a plurality of electrical switches for sequentially operating the heaters, the switch construction having a temperature sensing means operatively interconnected to the switches for moving and holding the same in open conditions thereof when the temperature sensing senses a high temperature condition of the heaters.

Accordingly, it is an object of this invention to provide an improved electrical furnace construction having one or more of the novel features set forth above or hereinafter shown or described.

Another object of this invention is to provide an improved part for such an electrical furnace construction, the improved part of this invention having one or more of the novel features set forth above or hereinafter shown or described.

Other objects, uses, and advantages of this invention are apparent from a reading of this description which proceeds with reference to the accompanying drawings forming a part thereof and wherein.

Figure 1:
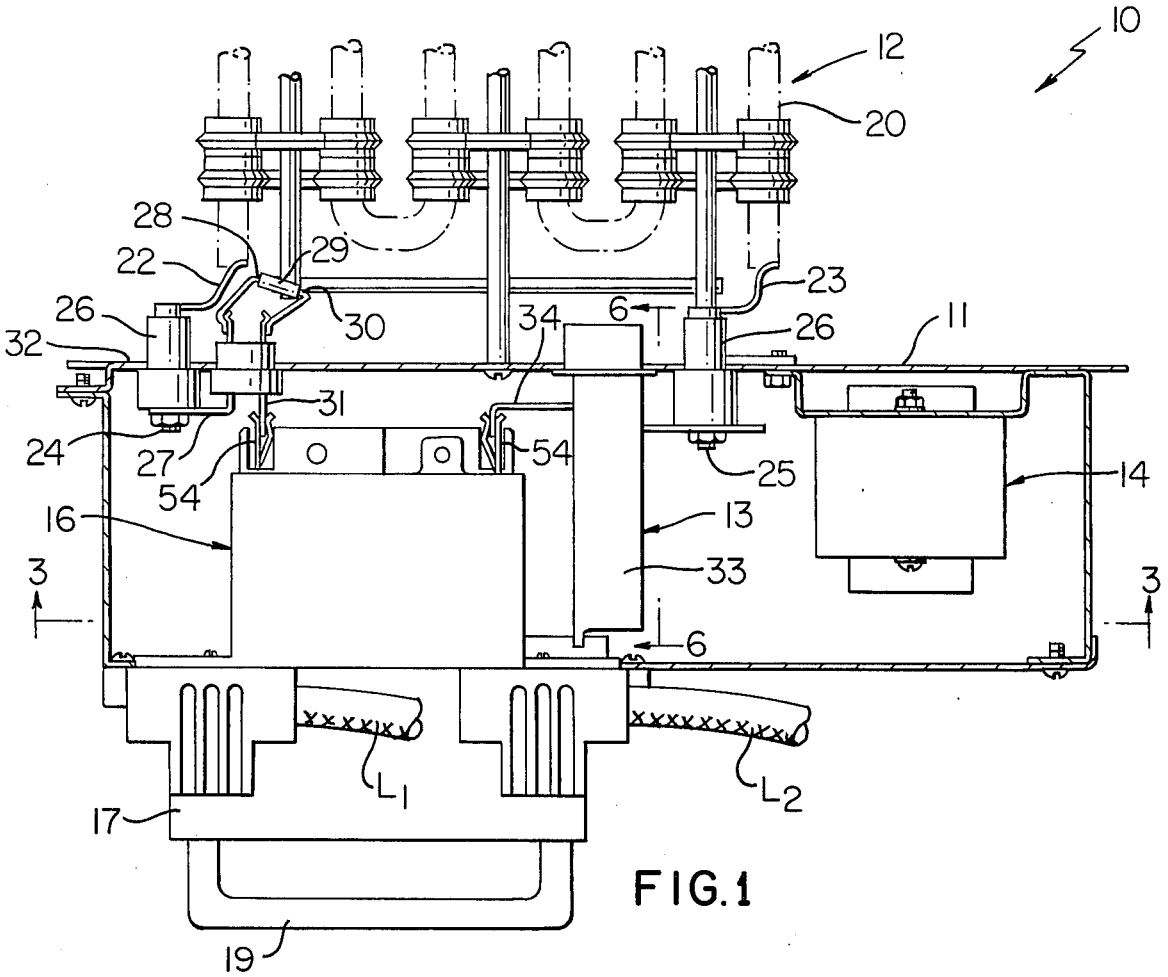
FIG. 1 is a fragmentary top view of the improved electrical furnace construction of this invention.
Figure 2:
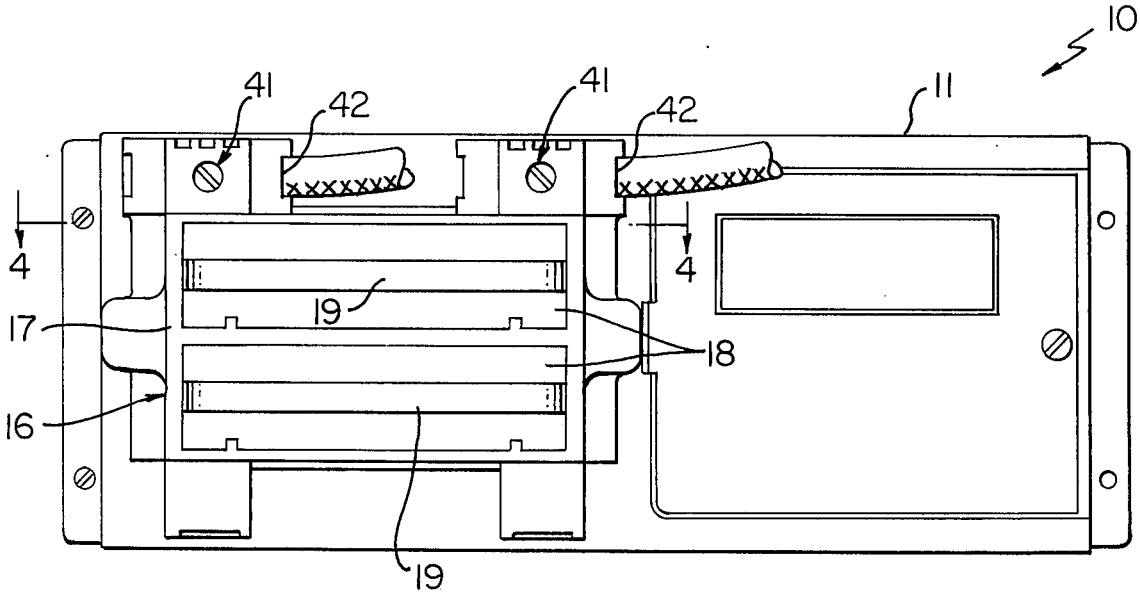
FIG. 2 is a front view of the construction illustrated in FIG. 1.

While the various features of this invention are hereinafter illustrated and described as being particularly adapted to control an electrical furnace construction, it is to be understood that the various features of this invention can be utilized singly or in any combination thereof to control other devices as desired.

Therefore, this invention is not to be limited to only the embodiments illustrated in the drawings, because the drawings are merely utilized to illustrate one of the wide variety of uses of this invention.

Referring now to FIGS. 1–5, the improved electrical furnace construction of this invention is generally indicated by the reference numeral 10 and comprises a frame means 11 adapted to be secured in an electrical furnace in such a manner that a unit of a plurality of electrical heaters there are carried by the frame means 11 and is generally indicated by the reference numeral 12 in FIG. 1 will be disposed within the heating chamber of the furnace to provide heat when the electrical heater unit 12 is interconnected to power source leads L-1 and L-2 by an electrical sequencing switch construction of this invention that is generally indicated by the reference numeral 13 in FIG. 1 and is also carried by the frame means 11.

The frame means 11 also carries a transformer 14, FIGS. 1 and 3, and an electrical relay 15 for a purpose hereinafter described.

The frame means 11 also carries a rigid lead unit of this invention that is generally indicated by the reference numeral 16 and comprises a housing means 17 secured to the frame means 11 and a pair of drawer-like members 18 each having a handle 19 for being pulled out of the housing means 17 for a fuse disconnecting and/or switching operation as will be apparent hereinafter.

The electrical heating unit 12 comprises a plurality of electrical heaters disposed in stacked relation and in the electrical furnace construction 10 of this invention, four electrical heaters are provided but only the top electrical heater is illustrated in FIG. 1 and is indicated by the reference numeral 20, the other electrical heaters being substantially identical to the heater 20 and being disposed below the same in stacked relation in FIG. 1. The four electrical heaters for the electrical furnace construction 10 of this invention are schematically illustrated in the electrical control system 21 of this invention in FIG. 9, the electrical heaters being indicated by the reference numerals 20A, 20B, 20C, and 20D.

As illustrated in FIG. 1, each electrical heater 20A-20D has opposed ends 22 and 23 respectively and electrically interconnected to conductive posts 24 and 25 carried by the frame means 11 and electrically insulated therefrom by ceramic bushings 26 in a manner well known in the art. The posts 24 at the ends 22 of the heaters 20A–20D are respectively and electrically interconnected by conductors 27 to one side 28 of thermal fuses 29 each of which has its other side 30 electrically interconnected to a terminal means 31 for the respective heater 20A–20D, two heaters 20A and 20B respectively having the ends 22 thereof interconnected to the upper terminal means 31 as illustrated in FIG. 3 while the ends 22 of the other pair of electrical heaters 20C and 20D are interconnected to the lower terminal means 31 illustrated in FIG. 3. The terminal means 31 each comprise a blade like member extending outwardly from a front plate 32 of the framing means 11 as illustrated in FIGS. 1 and 3 for a purpose hereinafter described.

Each thermal fuse 29 and its arrangement can be of the type disclosed in U.S. Pat. No. 3,924,217 and do not form a part of this invention. However, each fuse 29 functions to open the electrical circuit to the respective electrical heater 20A–20D should the temperature being sensed by the device 29 exceed a certain high unsafe temperature which is a temperature above the high unsafe temperature that will cause the electrical sequencing switch construction 13 of this invention to open the electrical circuits to the heater means 20A–20D in a manner hereinafter set forth.

Figure 3:
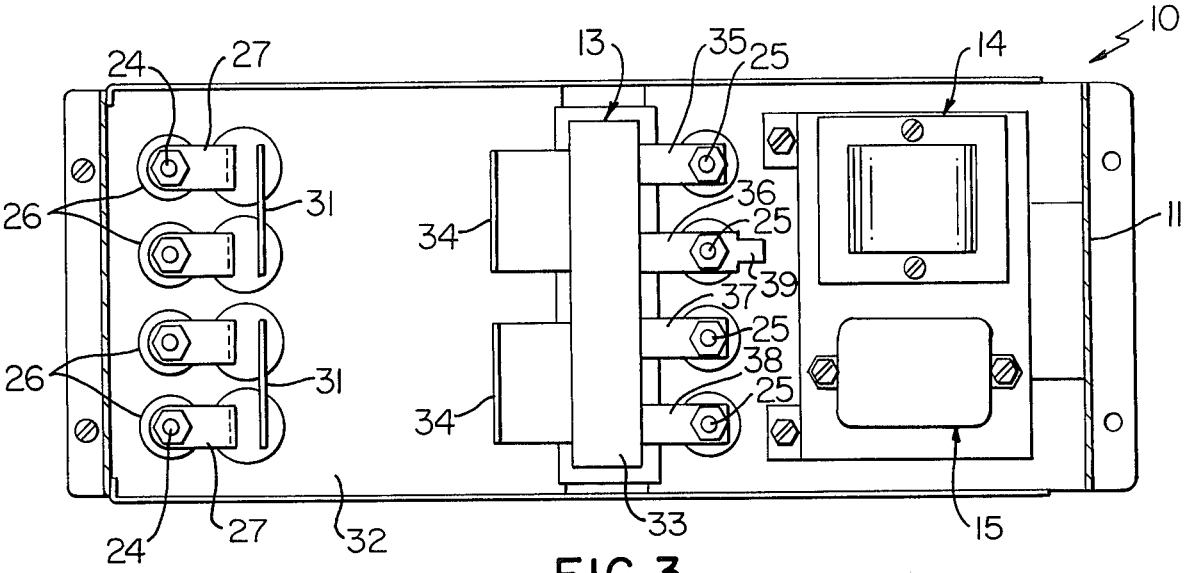
FIG. 3 is a cross-sectional view taken along line 3—3 of FIG. 1 with the rigid lead unit of this invention having been removed therefrom.

The electrical sequencing switch construction 13 includes a housing means 33 provided with a pair of blade-like L-shaped terminal means 34 arranged as illustrated in FIG. 3 wherein there is an upper blade-like terminal 34 similar to the upper heater terminal means 31 and a lower blade-like terminal means 34 arranged similar to the lower terminal means 31 of the heater means for a purpose hereinafter described.

Figure 9:
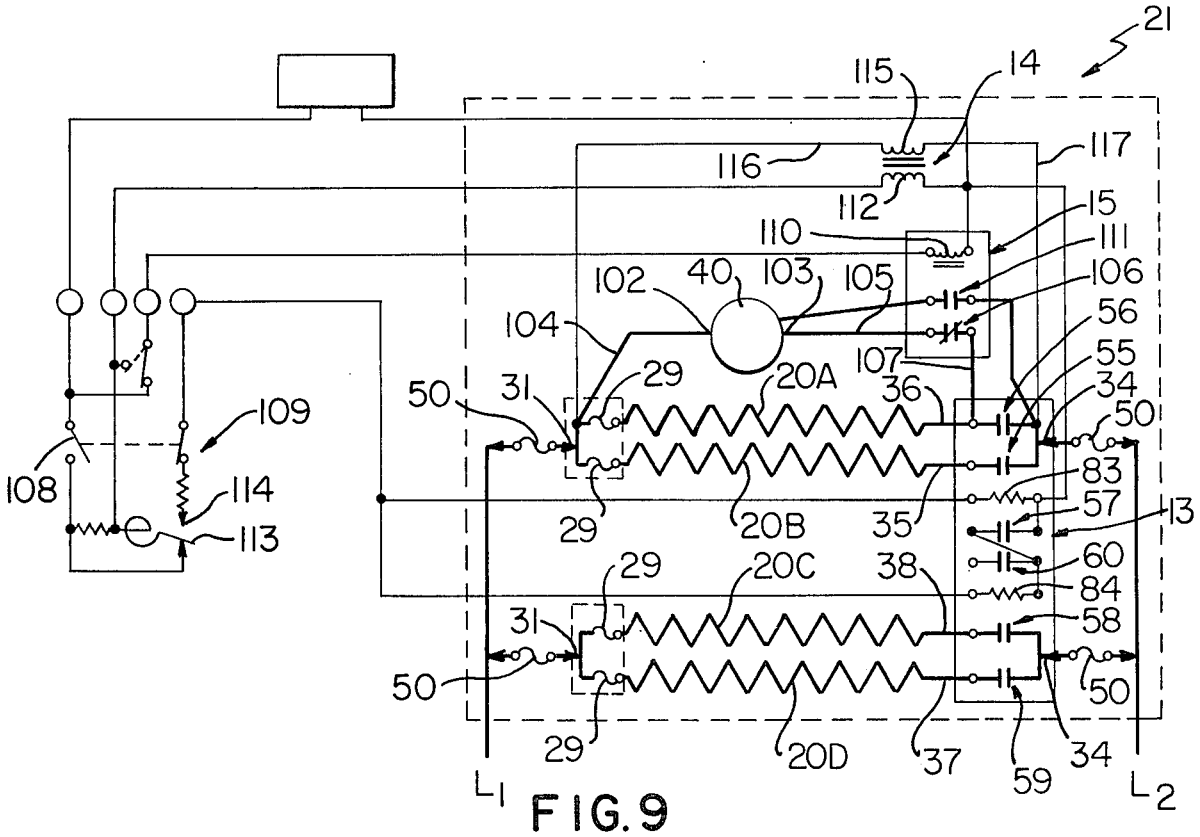
FIG. 9 is a wiring diagram schematically illustrating the electrical control system of this invention utilizing the electrical furnace construction of FIG. 1.

The housing 33 of the electrical sequencing switch construction 13 also has four terminal blades 35, 36, 37, and 38 extending from the other side thereof and each adapted to be electrically interconnected to the terminal posts 25 for the electrical heaters 20A–20D, the blade 36 having an extension 39 thereon for also being electrically interconnected to the relay 15 for assuring that the fan motor 40, FIG. 9, will be turned on at the same time that the first electrical heater 20A is energized as will be apparent hereinafter.

Figure 4:
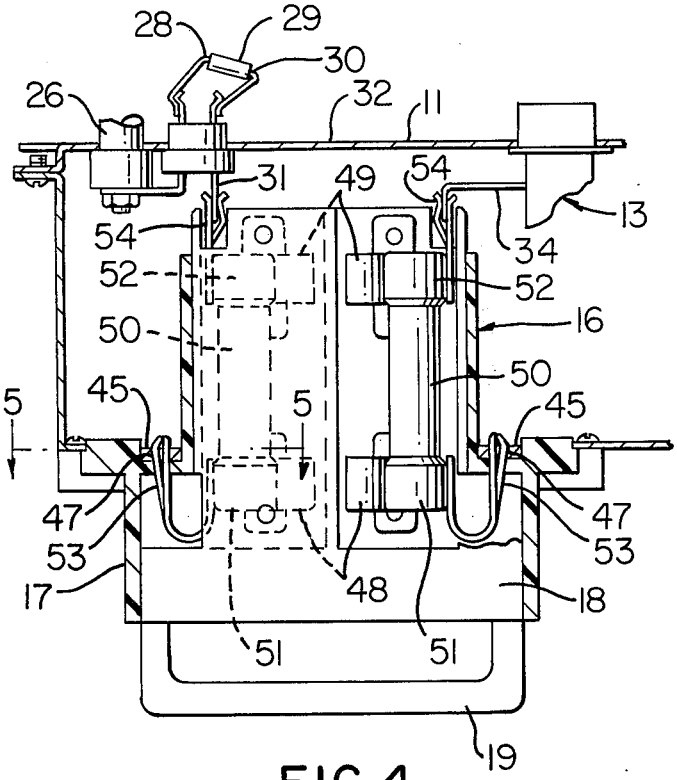
FIG. 4 is a fragmentary cross-sectional view taken on line 4—4 of FIG. 2.
Figure 5:
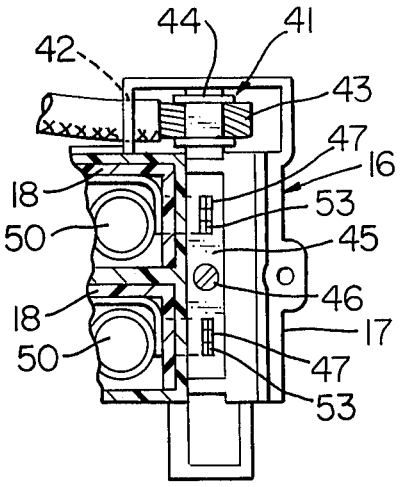
FIG. 5 is a fragmentary cross-sectional view taken on line 5—5 of FIG. 4.

The housing 17 of the rigid lead unit 16 has a pair of terminal means 41 adapted to respectively receive the bared ends 43 of the power source leads L-1 and L-2 in an opening 42 thereof, the bared end 43 of the respective lead L-1 or L-2 being adapted to be electrically clamped in place by a lead tightening clamp 44 of the terminal means 41 in a manner well known in the art and as illustrated in FIG. 5. Each lead tightening clamp 44 is electrically interconnected to a rigid conductive bus-bar or rigid lead means 45 fastened to the housing means 17 by fastening means 46 as illustrated in FIG. 5, the bus-bar means 45 for each terminal means 41 having a pair of aligned slots 47 passing therethrough as illustrated in FIGS. 4 and 5 for a purpose hereinafter described.

The two drawers 18 for the housing 17 of the rigid lead unit 16 are identical and each includes a first pair of electrically conductive ferrule-like parts 48 and a second pair of electrically conductive ferrule-like parts 49 spaced therefrom in aligned relation so that a pair of conventional cylindrical fuses 50 can be carried by each drawer 18 and have the respective opposed conductive ends 51 and 52 thereof snapped into the opposed ferrule-like parts 48 and 49 to not only electrically interconnect the ferrule-like parts 48 and 49 together, but also to provide a suitable fuse length therebetween.

The first pair of ferrule-like parts 48 for each drawer 18 has a conductive bayonet-type of projection 53 looped therefrom and extending in the direction parallel to the fuses 50 as illustrated. The bayonet spears 53 of the ferrule-like parts 48 are so constructed and arranged that when the particular drawer 18 is fully pushed into the housing 17 as illustrated in FIG. 4, the bayonet-type of projections 53 are adapted to be forced through respective slots 47 of the bus-bars 45 of the terminal means 41 as illustrated to electrically interconnect the bus-bars 45 to the first pair of ferrule-like parts 48 for each drawer 18. The bayonet-type of projections 53 are split as illustrated to provide resilient engagement with the bus-bars 45 at the slots 47 thereof.

The other pair of ferrule-like parts 49 for each drawer 18 also have bayonet-type of projections 54 extending therefrom beyond the fuses 50 so that when the particular drawer 18 is fully pushed into place as illustrated in FIG. 4, the bayonet-type of connections 54 receive the terminals 31 and 34 of the heater means 12 and control means 13 in spring slits thereof to electrically interconnect such terminals 31 and 34 respectively to the ferrule-type of parts 49 of the rigid lead unit 16.

In this manner, it can be seen that the left hand fuses 50 in FIG. 4 for the drawers 18 of the rigid lead unit 16 are adapted to interconnect the power source lead L-1, through the rigid bus-bar 45 and bayonet-type of connections 53 and 54, to the ends 22 of the heaters 20A–20D while the right hand fuses 50 of the drawers 18 electrically interconnect the power source lead L-2, through the right hand bus-bar 45 and bayonet-type of connections 53 and 54, to the terminal means 34 of the control means 13 as illustrated. In this manner, both sides of the circuit between the power source leads L-1 and L-2 are protected by the fuses 50 as illustrated in FIG. 9 and such interconnection of the power source leads L-1 and L-2 to the terminal means 31 and 34 of the heater means 12 and the control means 13 is accomplished by the rigid lead means of the unit 16 so that no auxiliary flexible wiring is required as in prior known arrangements.

However, when a particular drawer 18 has its handle 19 grasped and pulled outwardly, the bayonet-type of connections 53 of the drawer 18 not only disconnect from the bus-bar means 45, but also the bayonet-type of connection 54 thereof disconnect from the terminal 31 and 34 of the heater means 12 and control means 13 and thereby provide a switch breaking function, such opening of the drawer 18 being for safety maintenance purposes and also for changing the fuses 50 thereof.

Thus, in order to hook up the electrical furnace construction 10 of this invention to the power source lead L-1 and L-2, all that a person need do is loosen the connections 44 at the terminals 41 of the rigid lead unit 16 and insert the bared ends 43 of the power souce leads L-1 and L-2 therein. Thenafter, the clamping means 44 are tightened without requiring any additional flexible wiring between the power source leads L-1 and L-2 and the heater means 12 or control means 13 as required by prior known arrangements.

Figure 6:
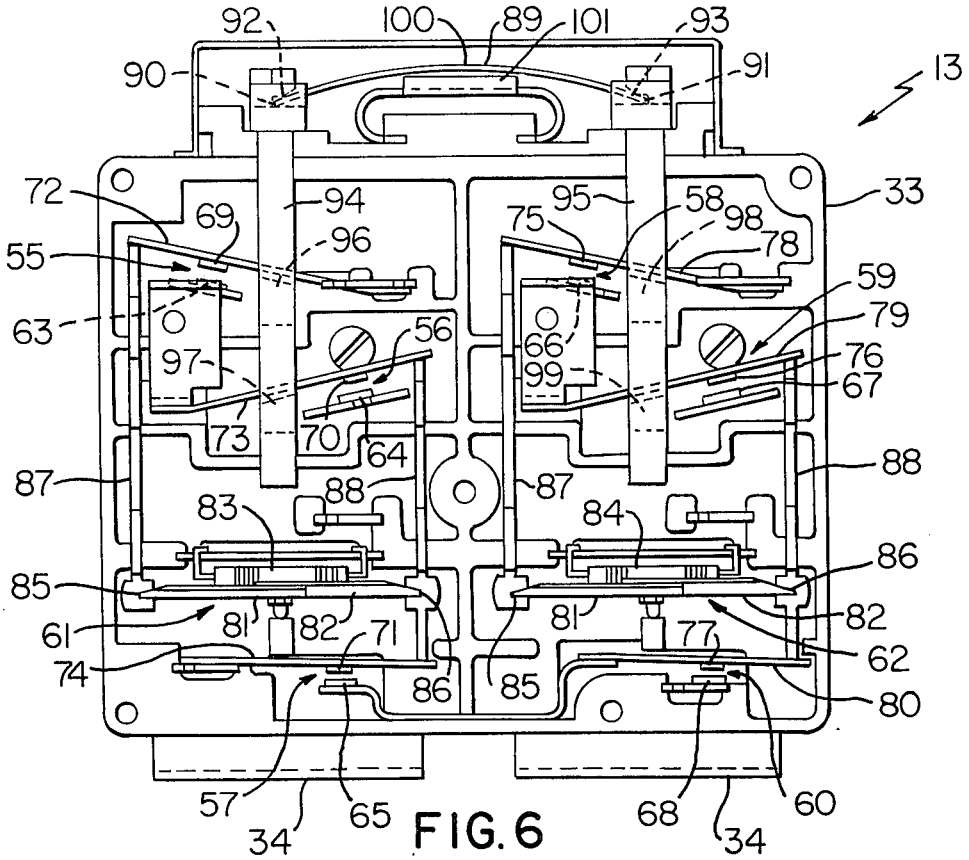
FIG. 6 is an enlarged fragmentary cross-sectional view taken on line 6—6 of FIG. 1 and illustrates the electrical sequencing switch construction of this invention having all of the electrical switches thereof disposed in their opened conditions.
Figure 7:
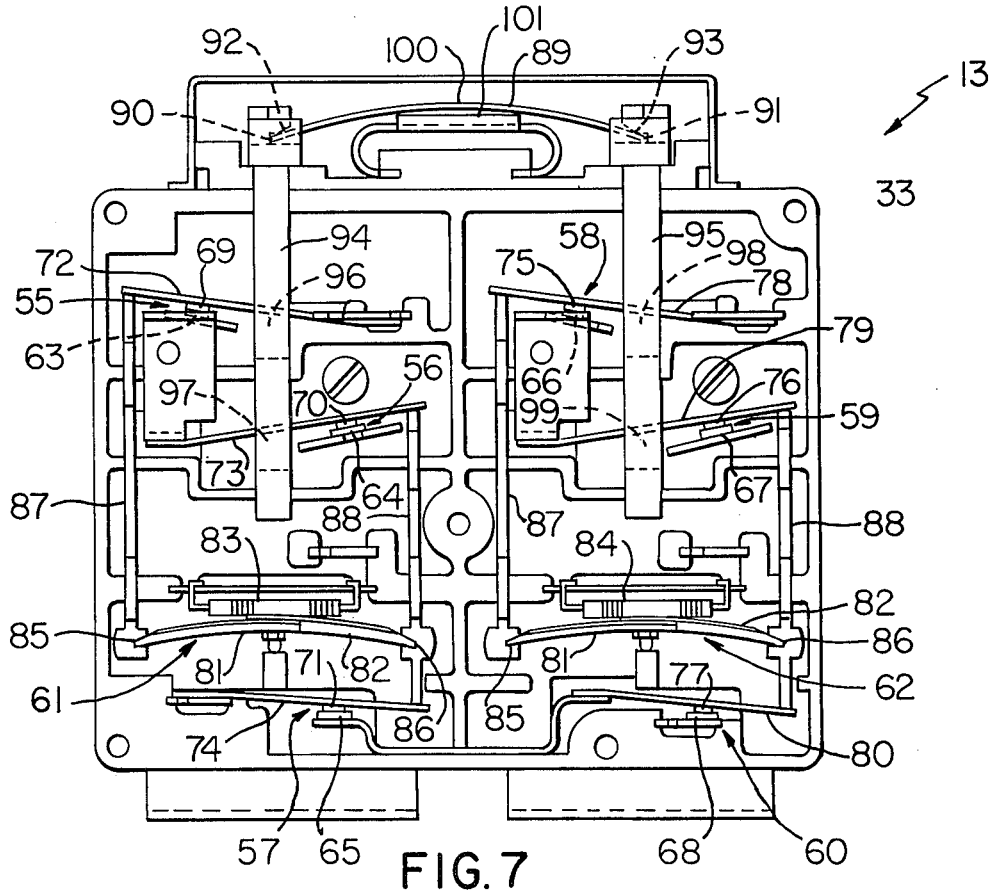
FIG. 7 is a view similar to FIG. 6 and illustrates the electrical switches after the same has been sequentially closed.
Figure 8:
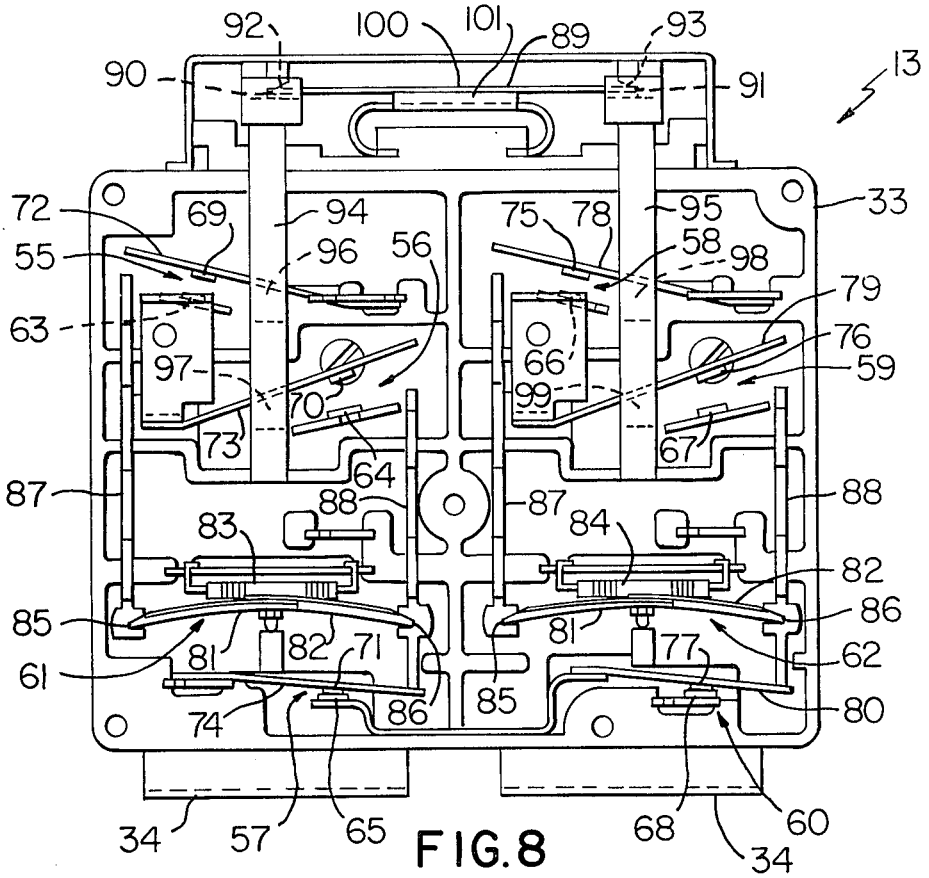
FIG. 8 is a view similar to FIG. 6 and illustrates the high temperature sensing means holding all the electrical switches in the opened condition thereof.

The electrical sequencing switch contruction 13 of this invention is best illustrated in FIGS. 6, 7, and 8 and includes six electrical switches that are respectively and generally indicated by the reference numerals 55, 56, 57, 58, 59, and 60 normally being disposed in their opened positions as hereinafter set forth and being adapted to be closed in a sequential manner by bimetal means that are generally indicated by reference numerals 61 and 62. The general operation and structure of the electrical sequencing switch construction 13 is fully described in U.S. Pat. No. 3,912,906 and therefore only sufficient details thereof need be described in this application in order to understand the teachings of this invention as reference can be had to U.S. Pat. No. 3,912,906 for further information on the structure and operation thereof.

The left hand tier of electrical switches 55, 56, and 57 respectively includes fixed contact means 63, 64, and 65 each being electrically interconnected to the upper terminal means 34 illustrated in FIG. 3. Similarly, the right hand tier of electrical switches 58, 59, and 60 respectively includes fixed contact means 66, 67, and 68 each being electrically interconnected to the lower terminal means 34 of FIG. 3.

The left hand tier of electrical switches 55, 56, and 57 respectively includes movable contact means 69, 70, and 71 respectively carried on cantilever mounted spring switch blades 72, 73, and 74, the switch blades 72 and 73 each having a natural bias to move its respective contact 69 and 70 into contact with its cooperating fixed contact 63 and 64 as illustrated in FIG. 7 while the switch blade 74 has a natural bias to move its contact 71 out of contact with its cooperating contact 65.

Similarly, the right hand tier of electrical switches 58, 59, and 60 includes movable contacts 75, 76, and 77 carried by cantilever mounted spring switch blades 78, 79, and 80 having a normal bias the same as the blades 72, 73, and 74 for the same purpose previously described.

The bimetal means 61 and 62 each includes two parts 81 and 82 and are adapted to be respectively heated by electrical heaters 83 and 84 when the heaters 83 and 84 are energized in a manner hereinafter described whereby the opposed ends 85 and 86 of the respective bimetal means 61 and 62 snap downwardly in a particular sequence as will be apparent hereinafter to carry axially movable plunger means 87 and 88 therewith as illustrated in FIG. 7 so that the natural bias of the switch blades 72, 73, 78 and 79 can carry their respective movable contacts 69, 70, 75, and 76 into electrical contact with the fixed contacts 63, 64, 66 and 67 to complete an electrical circuit therebetween for a purpose hereinafter described. The plungers 88, when moved axially downwardly by the heated bimetal means 61 and 62, abut against the switch blades 74 and 80 to overcome the natural bias thereof and push the same downwardly to place the movable contacts 71 and 77 thereof respectively into electrical contact with the fixed contacts 66 and 68 for a purpose hereinafter described.

A temperature sensing high limit bimetal member 89 is carried by the housing means 33 of the switch means 13 and has opposed ends 90 and 91 respectively received in notches 92 and 93 formed in end parts of a pair of movable actuators 94 and 95 respectively having transversely disposed abutments 96, 97, 98, and 99 located below the movable switch blades 72, 73, 78, and 79 sufficient distances so that the same do not interfer with the normal operation of the movable switch blades 72, 73, 78, 79 during the operation of the bimetal means 61 and 62 as previously described.

However, when a high unsafe temperature is being sensed by the bimetal member 89, the medial portion 100 thereof warps downwardly and engages against an abutment means 101 on the housing means 13 in the manner illustrated in FIG. 8 and thereby cause the opposed ends 90 and 91 to warp upwardly in drawings and carry the actuators 94 and 95 therewith to thereby move and hold the movable switch blades 72, 73, 78, and 79 in the fully opened positions thereof as illustrated in FIG. 8 to thereby hold the electrical switches 55, 56, 58, and 59 in their opened conditions as long as the bimetal member 89 is sensing a high unsafe temperature. The bimetal member 89 is so arranged on the switch construction 13 that the same projects toward the heater means 20A–20d and thereby provides a high limit safety feature for the control system 21 as will be apparent hereinafter. However, when the temperature sensed by the bimetal member 89 falls below the previously described high unsafe temperature, the bimetal member 89 assumes the condition illustrated in FIG. 6 wherein the medial portion 100 is bowed and has the concave side thereof facing the abutment 101 and is spaced therefrom to permit the actuators 94 and 95 to be disposed in their non-interferring position for the electrical switches 55, 56, 58, and 59.

As illustrated in FIG. 9, the electrical switch 56 of the sequencing switch construction 13 when closed will interconnect a terminal 34 of the construction 13 to the end 23 of the heater 20A to place the same across the power leads L-1 and L-2 to energize and operate the heater 20A as well as to place the furnace fan motor 40 across the power source leads L-1 and L-2 as the opposed sides 102 and 103 of the motor 40 are respectively interconnected by leads 104 and 105 to a terminal means 31 and to a normallly closed switch 106 of the relay 15 that is interconnected to the terminal 36 of the switch construction 13 by a lead 107. The switch 106 of the relay 15 is only opened when a switch blade 108 of a room or building thermostat construction 109 is moved from the opened heat cycle position illustrated in FIG. 9 to a closed position for a cooling cycle of the system 21 whereby the closing of the blade 108 energizes a solenoid 110 of the relay 15 to open the switch 102 and close a normally opened switch 111 of the relay 15 to place the side 103 of the motor 40 directly to a terminal means 34 and thereby bypass the switch 56. In this manner, the fan motor 40 can be continuously operated for the cooling cycle of the system 21 when the switch 108 is closed.

When the switch blade 108 is disposed in the open condition illustrated in FIG. 9, the system 21 is set for its heating cycle whereby the switch 106 of the relay 15 is closed and the switch 111 of the relay 15 is in the opened condition. Thus, the fan motor 40 will only be operated when the first heater means 20A is energized as the switch 56 controls the same, the fan motor 40 continuously operating as long as the first heater means 20A is in its "on" condition by the switch 56 being closed as will be apparent hereinafter.

The switch 55 controls the heater 20B so that the heater 20B is only placed across power source leads L-1 and L-2 when the switch 55 is closed.

The heater 83 for the bimetal means 61 of the switch construction 13 is adapted to be placed across a lower voltage power winding 112 of the transformer 14 when a thermostat bimetal 113 of the thermostat 109 moves from the temperature satisfied condition of FIG. 9 to a temperature non-satisfied condition against an electrical contact 114. Thus, when the thermostat 109 is sensing a temperature above the setting of the thermostat 109, the heater means 83 for the sequencing switch 13 is non-energized and when the thermostat 109 is sensing a temperature below the setting of the thermostat 109, the heater means 83 is placed across the lower voltage power winding 112 of the transformer 14 to be energized, the larger voltage power winding 115 of the transformer 14 being interconnected by leads 116 and 117 respectively to a pair of terminal means 31 and 34 as illustrated so as to be continuously operated as long as the rigid lead unit 16 is electrically interconnecting the power source leads L-1 and L-2 to the terminal means 31 and 34.

The switch 57 when closed will interconnect one side of the transformer winding 112 to the heater 84 for the bimetal means 62 and since the other side of the heater 84 is interconnected by a lead means 116 to the other side of the power winding 112 of the transformer 14, the heater 84 will be energized.

The switch 60 is adapted to control another electrical sequencing switch construction 13 (not shown) if the same is interconnected to the terminal 117 in series with the sequencing switch 13 of the system 21.

The switch 58 is adapted to control the heater 20C and the switch 59 is adapted to control the heater 20D whereby the switches 56, 55, 57, 60, 58, and 59 are adapted to operate the heater means 20A–20D in sequence as will be apparent hereinafter.

Thus, it can be seen that the electrical furnace construction 10 of this invention holds the flexible wiring between the power source leads L-1 and L-2, the heater means 12 and the control means 13, 14, and 15 at an absolute minimum while still providing for proper fusing at the heater means 12 because of the rigid lead unit 16 and switch construction 13 of this invention. Also, it can be seen that the electrical furnace construction 10 of this invention provides for a high limit control of the heater unit 12 because of the unique bimetal member 89 of the sequencing switch construction 13.

The operation of the control system 21 and its electrical furnace construction 10 will now be described.

With the drawers 18 of the rigid lead unit 16 in their pushed in condition as illustrated in FIG. 4 and with the thermostat 109 set for a desired temperature, such as 70° F, as long as the temperature being sensed by the thermostat 109 is above 70° F, the bimetal member 113 of the thermostat 109 is in the heat satisfied condition illustrated in FIG. 9 whereby the heater 83 of the sequencing switch construction 13 is not placed across the lower voltage winding 112 of the transformer 14 so that the heater 83 is in a non-energized condition thereof. With the heater 83 being in a non-energized condition, the bimetal means 61 therefor is in the cooled condition illustrated in FIG. 6 so that the plungers 87 and 88 maintain the switches 55, 56, and 57 in the open condition illustrated and since the open switch 57 controls the heater 84 for the bimetal means 62, the heater means 84 is likewise non-energized so that the bimetal means 62 is in the up condition and its plungers 86 and 88 maintain the switches 58, 59, and 60 in the open condition illustrated in FIG. 6. Thus, none of the electrical heaters 20A–20D are energized and the electrical furnace construction is not delivering any heat.

However, when the temperature being sensed by the thermostat 109 falls below the setting of the thermostat 109, the bimetal member 113 closes against the contact 114 to place the heater 83 across the transformer 14 so that the heater 83 is energized and begins to heat the bimetal means 61. The bimetal means 61 is so constructed and arranged that the part 81 thereof first snaps downwardly when heated to pull the plunger 87 downwardly whereby the switch 55 is first closed and places the heater 20A across the power source leads L-1 and L-2 to cause the same to heat as well as places the electrical fan motor 40 across the power source leads L-1 and L-2 to operate the blower or fan of the furnace. Subsequently, the part 82 of the bimetal means 61 snaps downwardly to pull the plunger 88 downwardly and close the switches 56 and 57 whereby the closed switch 56 now places the heater 20B across the power source L-1 and L-2 to add its heating function to the furnace. The closing of the switch 57 now places the heater 84 for the second or right hand bimetal means 62 across the transformer 14 so that the energized heater 84 will operate the bimetal means 62 in a sequence of first snapping its part 81 downwardly to close the switch 58 and operate the heater 20C and thereafter snap the part 82 downwardly to close the switch 59 and place the heater 20D across the power source leads L-1 and L-2 so that all four heaters 20A–20D will now be supplying heat in their furnace chamber.

Of course, during the above described sequence of operation of the switch construction 13, should the thermostat 109 be satisfied so that the same moves the bimetal member 113 away from the contact 114, not all of the heaters 20A–20D will be turned on in the sequence previously described as the heaters already energized will be turned off and the non-energized heaters will not be turned on. But, should the heat demand of the thermostat 109 require all four heaters 20A–20D to be turned on before the thermostat 109 is satisifed, all heaters 20A–20D will be energized by the sequencing switch 13 in the manner previously described.

If during the heating operation of the heaters 20A–20D in the manner previously described, the heaters 20A–20D should provide an adverse run-away condition so that an unsafe high temperature is reached by the heater unit 12, the bimetal member 89 of the switch construction 13 will sense such a high temperature condition of the heater unit 12 before the individual thermal limiters 29 senses their actuating higher temperature whereby the thus heated bimetal member 89 will warp from the condition illustrated in FIG. 7 to the condition illustrated in FIG. 8 to thereby pull upwardly on the actuators 94 and 95 and hold the switches 55, 56, 58 and 59 in the open condition illustrated in FIG. 8 as previously described and thereby disconnect all of the heaters 20A–20D from across the power source leads L-1 and L-2 to terminate their operation thereof until the adverse high temperature condition ceases to exist. At such time, the bimetal member 89 will warp back to the condition illustrated in FIG. 7 to permit the switches 55, 56, 58, and 59 to be operated in the normal manner previously described.

When the thermostat 109 is satisfied during a heating operation, the bimetal member 113 moves away from the contact 114 to thereby disconnect the heaters 83 and 84 from the transformer 14 so that the bimetal means 61 and 62 can now cool and snap back upwardly from the condition illustrated in FIG. 7 to the condition illustrated in FIG. 6 and move the plungers 87 and 88 upwardly to open all of the electrical switches 55, 56, 57, 58, 59, and 60 to turn off all of the heaters 20A–20D until the thermostat 109 again demands heat and as previously described.

If during the operation of the control system 21 for the electrical furnace, one of the fuses 50 should blow or it is desired to service the electrical furnace for some other reason, the person can disarm the control system 21 by merely pulling the drawers 18 out of the rigid lead housing 17 to disconnect the main bus-bars 45 from the terminal means 31 of the heater unit 12 as well as from the terminal means 34 of the control means 13 whereby the system 21 and/or furnace can be services as desired or the blow fuse or fuses 50 can be replaced in the removed drawers 18 in a safe manner.

Therefore, it can be seen that this invention not only provides an improved electrical furnace construction, but also this invention provides improved parts for such a furnace construction or the like.

While the form of the invention now preferred has been illustrated and described as required by the Patent Statute, it is to be understood that other forms can be utilized and still fall within the scope of the appended claims.

What is claimed is:

1. In combination, a frame means, a plurality of electrical heaters carried by said frame means and having terminal means, control means carried by said frame means for said heaters and having terminal means, and a rigid lead unit carried by said frame means and having rigid lead means directly and electrically interconnected to said terminal means of said heaters and said control means, said unit having terminal means for electrically interconnecting said rigid lead means to power source leads whereby said power source leads will be directly and electrically interconnected to said terminal means of said heaters and said control means by said rigid lead means, said rigid lead unit having a manually operated switch means for opening said rigid lead means to disconnect said power source leads from said heaters and said control means, said rigid lead unit having a removable section, said section carrying part of said rigid lead means and thereby defining a part of said switch means, said part of said rigid lead means of said section having connections for axially interconnecting with said terminal means of said heaters and said control means when said section is axially moved to one position relative to said unit and for axially disconnecting with said terminal means of said heaters and said control means when said section is axially moved to another position relative to said unit, said section having other connections disposed intermediate said terminal means for said power leads and said connections for said terminal means of said heaters and said control device, said other connections axially interconnecting with said rigid lead means disposed between said section and said terminal means for said power source leads when said section is axially moved to said one position thereof and for axially disconnecting with said rigid lead means disposed between said section and said terminal means for said power source leads when said section is axially moved to said other position thereof.

2. A combination as set forth in claim 1 wherein said section has electrical fuse means in said part of said rigid lead means thereof.

3. A combination as set forth in claim 2 wherein said section is drawer-like in its relation with said unit.

4. In combination, a frame means, a plurality of electrical heaters carried by said frame means and having terminal means, control means carried by said frame means for said heaters and having terminal means, and a rigid lead unit carried by said frame means and having rigid lead means directly and electrically interconnected to said terminal means of said heaters and said control means, said unit having terminal means for electrically interconnecting said rigid lead means to power source leads whereby said power source leads will be directly and electrically interconnected to said terminal means of said heaters and said control means by said rigid lead means, said rigid lead unit having a manually operated switch means for opening said rigid lead means to disconnect said power source leads from said heaters and said control means, said rigid lead unit having a removable section, said section carrying part of said rigid lead means and thereby defining part of said switch means, said part of said rigid lead means of said section having bayonet-type connections for axially interconnecting with said terminal means of said heaters and said control means when said section is axially moved to one position relative to said unit and for axially disconnecting with said terminal means of said heaters and said control means when said section is axially moved to another position relative to said unit, said section having other bayonet-type connections disposed intermediate said terminal means for said power leads and the bayonet-type connections for said terminal means of said heaters and said control device, said other bayonet-type connections axially interconnecting with said rigid lead means disposed between said section and said terminal means for said power source leads when said section is axially moved to said one position thereof and for axially disconnecting with said rigid lead means disposed between said section and said terminal means for said power source leads when said section is axially moved to said other position thereof.

5. A combination as set forth in claim 4 wherein said section has electrical fuse means in said part of said rigid lead means thereof.

6. A combination as set forth in claim 5 wherein said section is drawer-like in its relation with said unit.

7. A rigid lead unit for attaching to a frame means of an electrical furnace that has a plurality of electrical heaters and control means for said heaters, said unit having rigid lead means for directly and electrically interconnecting to terminal means of said heaters and said control means, said unit having terminal means for electrically interconnecting said rigid lead means to power source leads whereby said power source leads will be directly and electrically interconnected to said terminal means of said heaters and said control means by said rigid lead means, said rigid lead unit having a manually operated switch means for opening said rigid lead means to disconnect said power source leads from said heaters and said control means, said rigid lead unit having a removable section, said section carrying part of said rigid lead means and thereby defining part of said switch means, said part of said rigid lead means of said section having connections for axially interconnecting with said terminal means of said heaters and said control means when said section is axially moved to one position relative to said unit and for axially disconnecting with said terminal means of said heaters and said control means when said section is axially moved to another position relative to said unit, said section having other connections disposed intermediate said terminal means for said power leads and said connections for said terminal means of said heaters and said control device, said other connections axially interconnecting with said rigid lead means disposed between said section and said terminal means for said power source leads when said section is axially moved to said one position thereof and for axially disconnecting with said rigid lead means disposed between said section and said terminal means for said power source leads when said section is axially moved to said other position thereof.

8. A rigid lead unit as set forth in claim 7 wherein said section has electrical fuse means in said part of said rigid lead means thereof.

9. A rigid lead unit as set forth in claim 8 wherein said section is drawer-like in its relation with said unit.

10. A rigid lead unit for attaching to a frame means of an electrical furnace that has a plurality of electrical heaters and control means for said heaters, said unit having rigid lead means for directly and electrically interconnecting to terminal means of said heaters and said control means, said unit having terminal means for electrically interconnecting said rigid lead means to power source leads whereby said power source leads will be directly and electrically interconnected to said terminal means of said heaters and said control means by said rigid lead means, said rigid lead unit having a manually operated switch means for opening said rigid lead means to disconnect said power source leads from said heaters and said control means, said rigid lead unit having a removable section, said section carrying part of said rigid lead means and thereby defining part of said switch means, said part of said rigid lead means of said section having bayonet-type connections for axially interconnecting with said terminal means of said heaters and said control means when said section is axially moved to one position relative to said unit and for axially disconnecting with said terminal means of said heaters and said control means when said section is axially moved to another position relative to said unit, said section having other bayonet-type connections disposed intermediate said terminal means for said power leads and the bayonet-type connections for said terminal means of said heaters and said control device, said other bayonet-type connections axially interconnecting with said rigid lead means disposed between said section and said terminal means for said power source leads when said section is axially moved to said one position thereof and for axially disconnecting with said rigid lead means disposed between said section and said terminal means for said power source leads when said section is axially moved to said other position thereof.

11. A rigid lead unit as set forth in claim 10 wherein said section has electrical fuse means in said part of said rigid lead means thereof.

12. A rigid lead unit as set forth in claim 11 wherein said section is drawer-like in its relation with said unit.

13. In an electrical furnace having a frame means carrying a plurality of electrical heaters and control means for operating said heaters, said control means comprising an electrical sequencing switch construction carried by said frame means and having a plurality of electrical switches operated by a plurality of bimetal means for sequentially operating said heaters, the improvement wherein said switch construction has a temperature sensing means separate from said bimetal means and operatively interconnected to said switches for moving and holding the same in open conditions thereof when said temperature sensing means senses a high temperature condition of said heaters.

14. In an electrical furnace as set forth in claim 13, said temperature sensing means comprising a bimetal member.

15. In an electrical furnace as set forth in claim 14, said bimetal member having opposed ends, said switch construction having two actuators for moving and holding said switches in said open conditions thereof, said actuators being respectively interconnected to said opposed ends of said bimetal member.

16. In an electrical furnace as set forth in claim 15, said switch construction having an abutment against which a medial portion of said bimetal member can engage when said bimetal member is sensing said high temperature condition of said heaters, said medial portion of said bimetal member normally being bowed with the concave side facing and being spaced from said abutment when said bimetal member is sensing a temperature below said high temperature condition.

17. In an electrical sequencing switch construction for an electrical furnace having a frame means carrying a plurality of electrical heaters and control means for operating said heaters, said electrical sequencing switch construction having a plurality of electrical switches operated by a plurality of bimetal means for sequentially operating said heaters, the improvement wherein said switch construction has a temperature sensing means separate from said bimetal means and operatively interconnected to said switches for moving and holding the same in open conditions thereof when said temperature sensing means senses a high temperature condition of said heaters.

18. In an electrical sequencing switch construction as set forth in claim 17, said temperature sensing means comprises a bimetal member.

19. In an electrical sequencing switch construction as set forth in claim 18, said bimetal member having opposed ends, said switch construction having two actuators for moving and holding said switches in said open conditions thereof, said actuators being respectively interconnected to said opposed ends of said bimetal member.

20. In an electrical sequencing switch construction as set forth in claim 19, said switch construction having an abutment against which a medial portion of said bimetal member can engage when said bimetal member is sensing said high temperature condition of said heaters, said medial portion of said bimetal member normally being bowed with the concave side facing and being spaced from said abutment when said bimetal member is sensing a temperature below said high temperature condition.

* * * * *